US011333172B1

(12) United States Patent
Tzeng

(10) Patent No.: US 11,333,172 B1
(45) Date of Patent: May 17, 2022

(54) AIR MOVING DEVICE WITH STATOR BLADE STRUCTURE

(71) Applicant: Stokes Technology Development Ltd., Taoyuan (TW)

(72) Inventor: Yih-Wei Tzeng, Taoyuan (TW)

(73) Assignee: STOKES TECHNOLOGY DEVELOPMENT LTD., Taoyuan (TW)

( * ) Notice: Subject to any disclaimer, the term of this patent is extended or adjusted under 35 U.S.C. 154(b) by 0 days.

(21) Appl. No.: 17/501,919

(22) Filed: Oct. 14, 2021

(51) Int. Cl.

| | |
|---|---|
| ***F04D 29/32*** | (2006.01) |
| ***F04D 29/54*** | (2006.01) |
| ***F04D 29/38*** | (2006.01) |
| ***F04D 19/00*** | (2006.01) |

(52) U.S. Cl.
CPC ..... *F04D 29/544* (2013.01); *F04D 19/002* (2013.01); *F04D 29/329* (2013.01); *F04D 29/384* (2013.01)

(58) Field of Classification Search
CPC .... F04D 29/544; F04D 19/002; F04D 29/329; F04D 29/384
See application file for complete search history.

(56) References Cited

U.S. PATENT DOCUMENTS 6,302,640 B1 * 10/2001 McKelvey ..... F04D 29/526 415/57.4
8,764,375 B2 * 7/2014 Kato ..... F04D 19/007 415/68
2021/0388839 A1 * 12/2021 Li ..... F04D 29/703

FOREIGN PATENT DOCUMENTS

JP 5715469 B2 * 5/2015 ..... F04D 19/007

* cited by examiner

*Primary Examiner* — Sabbir Hasan
(74) *Attorney, Agent, or Firm* — Chun-Ming Shih; HDLS IPR Services

(57) ABSTRACT

The air moving device includes a rotor and a stator. The quantity of the rotor blades is not less than 5 and not greater than 12. The average blade angle of rotor blades is not less than 45 degrees and is not greater than 64 degrees. The ratio of the hub diameter to the rotor diameter is not less than 0.4 and not greater than 0.79. The quantity of the stator blades is not less than 6 and not greater than 23. The average blade angle of stator blades is not less than 45 degrees and not greater than 70 degrees. The ratio of the total thickness of the air moving device to the rotor diameter is not less than 0.76 and not greater than 1.7. The ratio of the stator axial thickness to the rotor axial thickness is not less than 0.28 and not greater than 0.65.

6 Claims, 12 Drawing Sheets

AIR MOVING DEVICE WITH STATOR BLADE STRUCTURE

BACKGROUND

Technical Field

The technical field relates to an air moving device for cooling, and more particularly relates to an air moving device with a stator blade structure.

Description of Related Art

An air moving device is composed of a motor, a hub and a plurality of blades arranged around the hub, and the motor drives the hub to rotate to let the blades induce the fluid flowing. In addition, the operation of the air moving device not only has to generate high air flowrate, but also needs to generate sufficient air pressure to effectively push fluid passing an environment with fluid resistance.

Moreover, in order to enhance the performance of the air moving, the air moving device may additionally dispose a plurality of stator blades connected to the hub or housing to configure a rotor-stator air moving device to improve the characteristic of static pressure versus air flowrate of the air moving device. However, under the design concept of the related art, the total thickness of a rotor-stator air moving device is restricted to a relatively small value, as shown in FIG. 9B and FIG. 10, the rotor 10*b* of the rotor-stator air moving device 1*b* is provided with stator blades 20*b* (rotor-stator structure). Moreover, when the total thickness of the rotor-stator air moving device is up to a certain level, the air moving device usually adopts the counter-rotating structure instead of single rotor-stator structure. As shown in FIG. 9C and FIG. 11, the counter-rotating air moving device 1*c* includes a front rotor 10*c* and a rear rotor 20*c* to enhance the performance of the air moving device.

However, since the operation of the counter-rotating air moving device in FIG. 9C and FIG. 11 requires two motors to drive the front rotor 10*c* and the rear rotor 20*c* respectively, thus, the cost of the counter-rotating air moving device is significantly increased comparing with the cost of a single motor driving device, and the manufacturing is also more complicated. Therefore, how to achieve the performance close to that of a counter-rotating air moving device by using a single motor is the motivation of the invention

SUMMARY

One object of this disclosure is to provide an air moving device with a stator blade structure. The curve of the static pressure versus air flowrate is close to that of a counter-rotating air moving device through the disclosed design of a single rotor and stator blade structure, which has advantages of reducing the cost and simplifying manufacturing.

In order to achieve the object mentioned above, this disclosure provides an air moving device with a stator blade structure with specific parameters. The air moving device includes a rotor and a stator. The rotor includes a rotor hub and a plurality of rotor blades arranged annularly on a periphery of the rotor hub spacedly. The rotor hub includes a hub diameter, and the rotor blades are with defined rotor diameter and rotor axial thickness. A quantity of the rotor blades is equal to or greater than 5 and equal to or less than 12, and an averaged blade angle of each of the rotor blades is equal to or greater than about 45 degrees and equal to or less than about 64 degrees, and a ratio of the hub diameter to the rotor diameter is equal to or greater than about 0.4 and equal to or less than about 0.79. The stator is disposed on a downstream side of the rotor. The stator includes a plurality of stator blades arranged annularly and spacedly, and the stator blades are with defined stator axial thickness. A quantity of the stator blades is equal to or greater than 6 and equal to or less than 23, and an averaged blade angle of each of the stator blades is equal to or greater than about 45 degrees and equal to or less than about 70 degrees. The air moving device has a total thickness, and a ratio of the total thickness to the rotor diameter is equal to or greater than about 0.76 and equal to or less than about 1.7, and a ratio of the stator axial thickness to the rotor axial thickness is equal to or greater than about 0.28 and equal to or less than about 0.65.

The relative total thickness of the air moving device with stator blade structure of this disclosure is greater than that of the rotor-stator moving device of the related art. Moreover, the rotor and the stator of the air moving device of this disclosure, under the specific design parameters disclosed in this disclosure, may achieve the curve of the static pressure versus air flowrate close to that of a counter-rotating air moving device by using the rotor-stator structure with a single motor to drive the rotor blades. Thus, this disclosure has advantages of reducing the cost, simplifying manufacturing and enhancing the practicability.

BRIEF DESCRIPTION OF DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
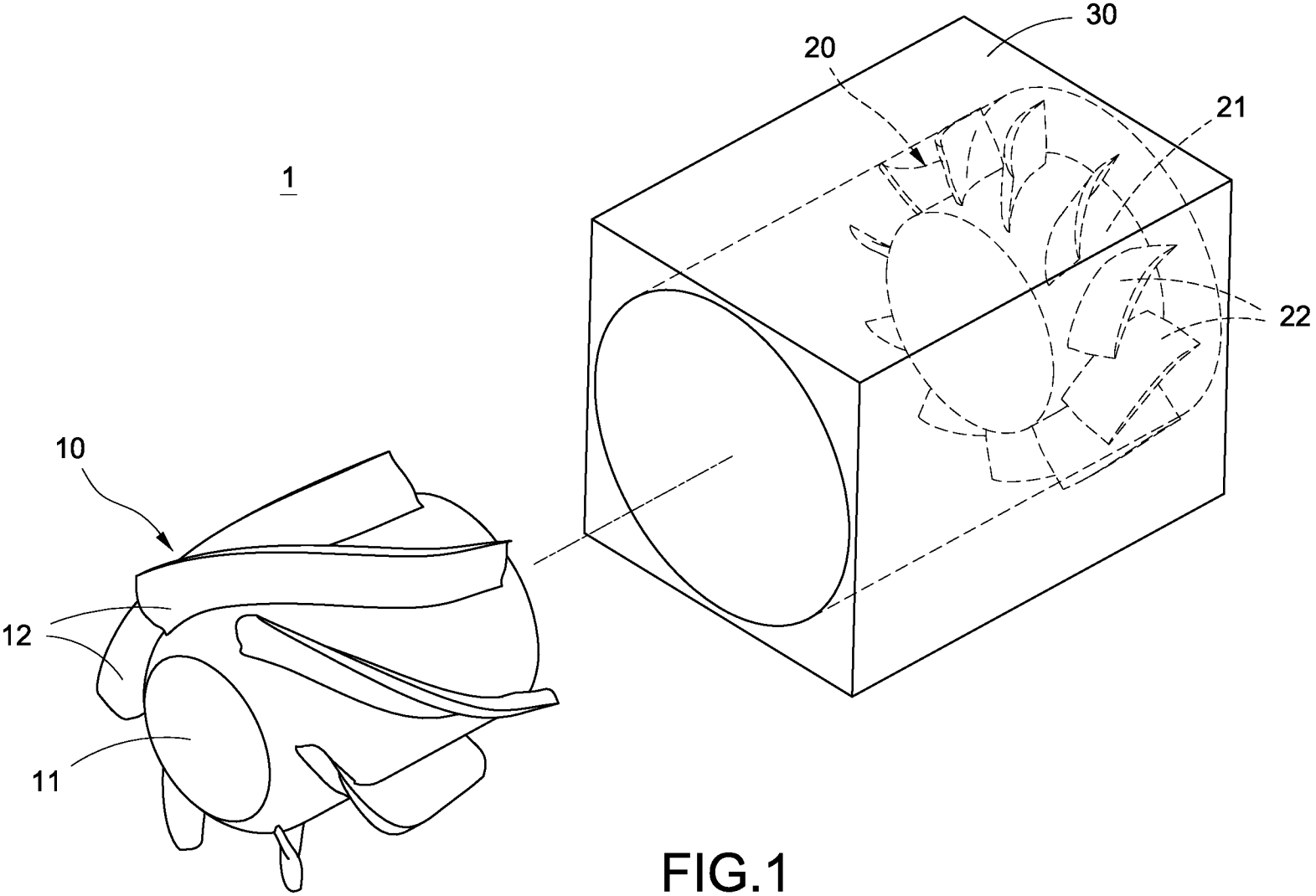
FIG. 1 is a perspective exploded schematic view of the air moving device with stator blade structure in this disclosure.
Figure 2:
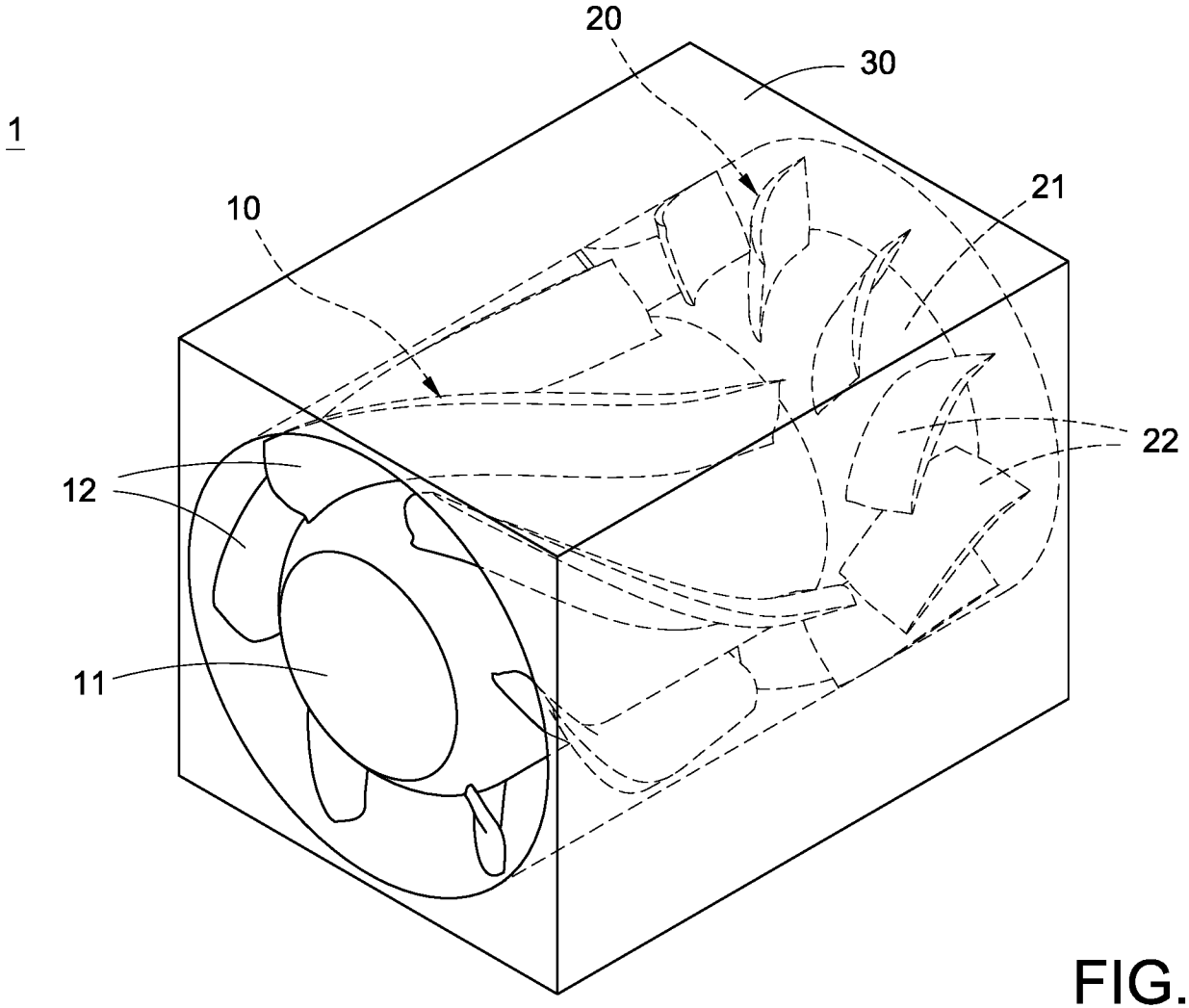
FIG. 2 is a perspective schematic view of the air moving device with stator blade structure in this disclosure.

Please refer to FIG. 1 and FIG. 2, which respectively depict a perspective exploded schematic view of the air moving device with stator blade structure in this disclosure and a perspective schematic view of the air moving device with stator blade structure in this disclosure. The air moving device 1 with stator blade of this disclosure includes a rotor 10, a stator 20, and a housing 30. The rotor 10 is combined in the housing 30. The stator 20 is fixed on the housing 30 and disposed on a downstream side of the rotor 10 to constitute the air moving device 1.

The rotor 10 includes a rotor hub 11 and a plurality of rotor blades 12 arranged annularly on a periphery of the rotor hub 11 spacedly. Additionally, the stator 20 includes a stator hub 21 and a plurality of stator blades 22 arranged annularly on the periphery of the stator hub 21 spacedly.

Figure 3:
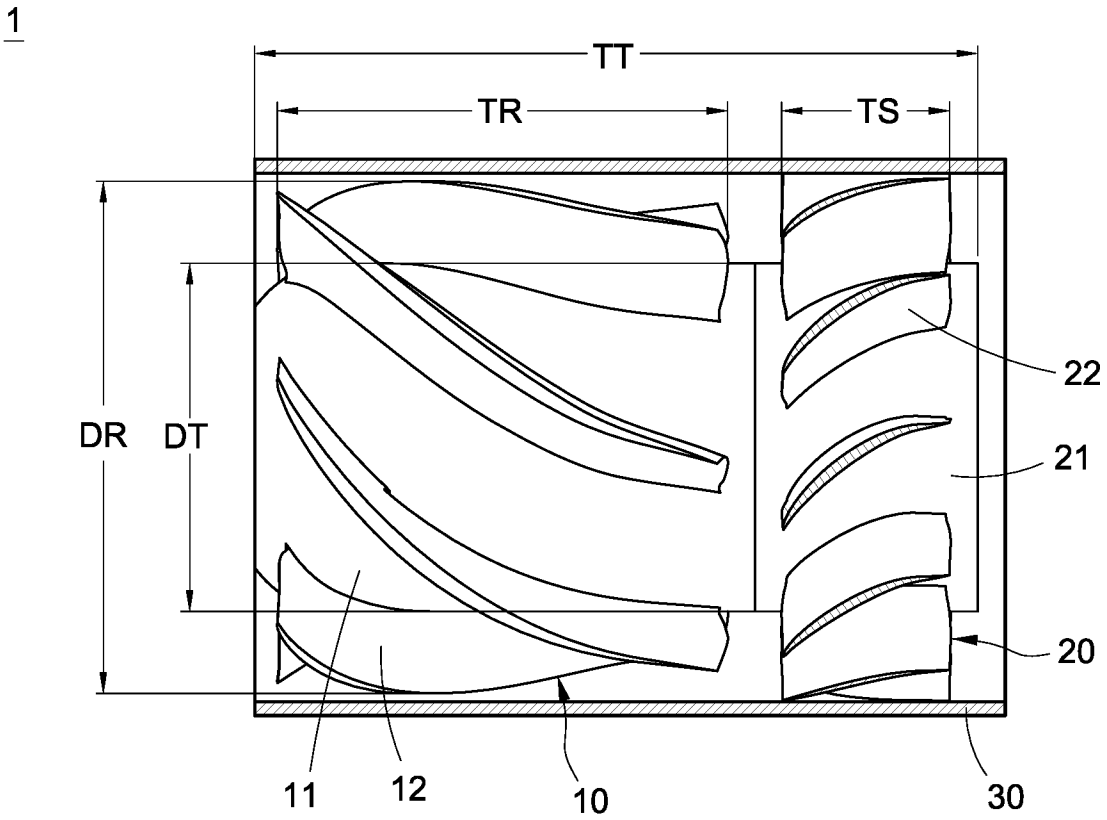
FIG. 3 is a cross sectional view of the air moving device with stator blade structure in this disclosure.

Please further refer to FIG. 3, it depicts a cross sectional view of the air moving device with stator blade structure in this disclosure. Specifically, in the structure of the rotor 10, the rotor hub 11 includes a hub diameter DT. The rotor blades 12 is with a rotor diameter DR and a rotor axial thickness TR. Additionally, the quantity of the rotor blades 12 is equal to or greater than 5 and equal to or less than 12. The ratio of the hub diameter DT to the rotor diameter DR is equal to or greater than about 0.4 and equal to or less than about 0.79.

Moreover, in the structure of the stator 20, the stator blades 22 is with a stator axial thickness TS, and the quantity of the stator blades 22 is equal to or greater than 6 and equal to or less than 23.

Furthermore, the air moving device 1 is with a total thickness TT (the thickness of the rotor 10 combined with the stator 20). The ratio of the total thickness TT to the rotor diameter DR is equal to or greater than about 0.76 and equal to or less than about 1.7. In addition, the ratio of the stator axial thickness TS to the rotor axial thickness TR is equal to or greater than about 0.28 and equal to or less than about 0.65.

Figure 4:
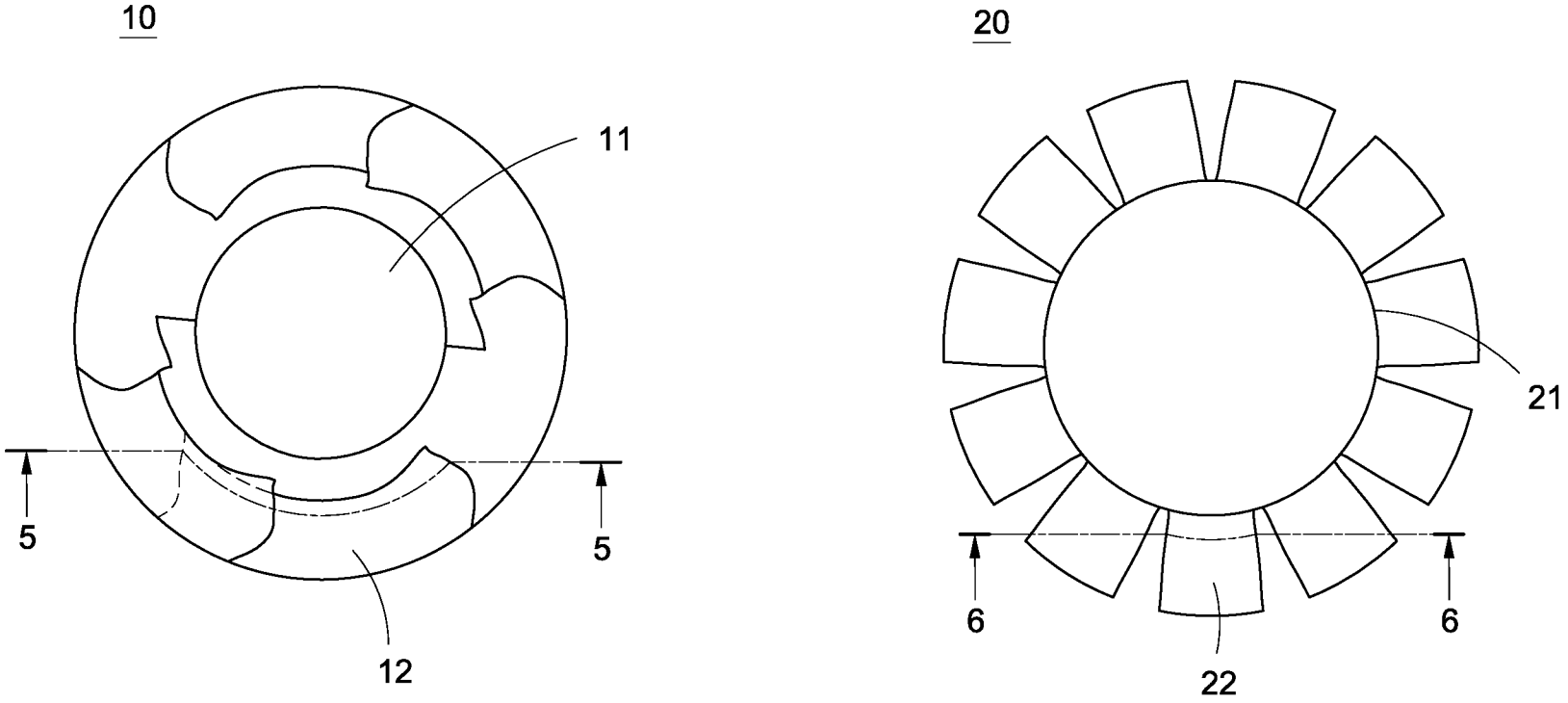
FIG. 4 is a front view of the rotor and the stator in this disclosure.
Figure 6:
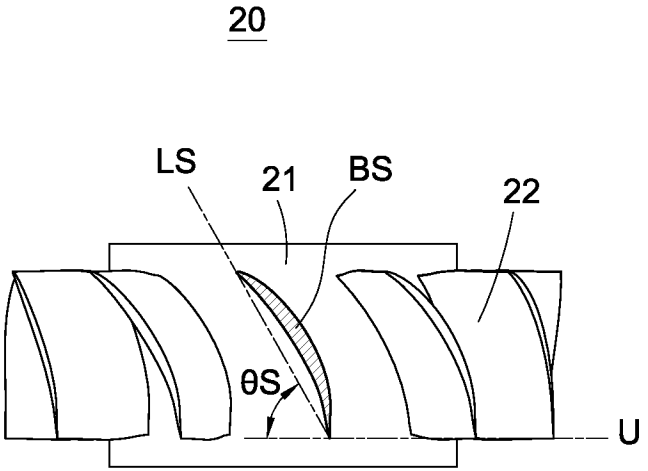
FIG. 6 is a schematic view of the blade angle of the stator in this disclosure.
Figure 5:
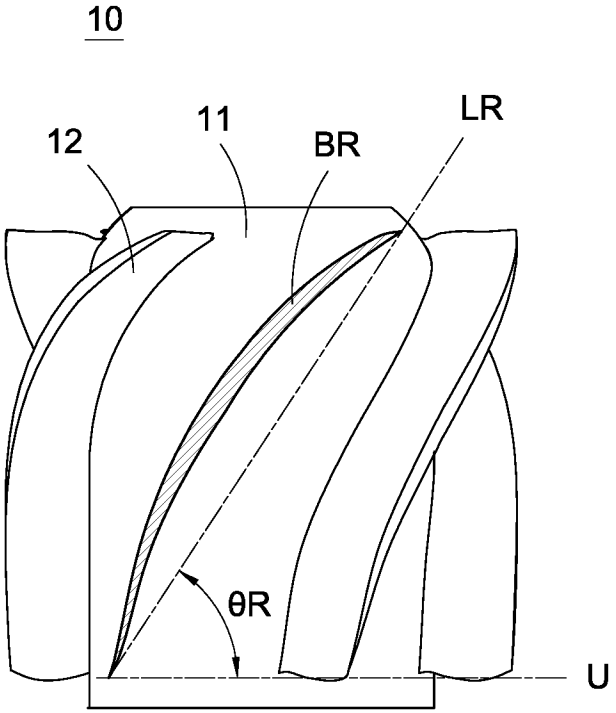
FIG. 5 is a schematic view of the blade angle of the rotor in this disclosure.

Please further refer to FIG. 4 to FIG. 6, they depict a front view of the rotor and the stator in this disclosure, a schematic view of the blade angle of the rotor in this disclosure, and a schematic view of the blade angle of the stator in this disclosure. In FIG. 4, the rotor blade 12 includes a wing section BR at any radius section of the blade, such as a cross section along the line 5-5. Please refer to FIG. 5, the angle formed by the nose-tail line LR of the wing section BR and the rotation direction U of the rotor 10 is a blade angle $\theta_R$. Moreover, the rotor blades 12 of the rotor 10 of this disclosure is with an averaged blade angle, which is the average value of the blade angles $\theta_R$ of different radius sections. The averaged blade angle of each rotor blade 12 is equal to or greater than about 45 degrees and equal to or less than about 64 degrees.

Furthermore, in FIG. 4, the stator blade 22 includes a wing section BS at any radius section of the blade, such as a cross section along the line 6-6. Please refer to FIG. 6, the angle formed by the nose-tail line LS of the wing section BS and the rotation direction U of the stator 20 is a blade angle $\theta_S$. Moreover, the stator blades 12 of the stator 20 of this disclosure is with an averaged blade angle, which is the average value of the blade angles of different radius sections. The averaged blade angle of each stator blade 12 is equal to or greater than about 45 degrees and equal to or less than about 70 degrees.

In this embodiment, the ratio of the total thickness TT to the rotor diameter DR is about 1.52. The ratio of the hub diameter DT to the rotor diameter DR is about 0.679. The ratio of the stator axial thickness TS to the rotor axial thickness TR is about 0.39. The quantity of the rotor blades is 6, and the quantity of the stator blades is 11. Additionally, the averaged blade angle $\theta_R$ of each rotor blade 12 is about 53.2, and the averaged blade angle $\theta_S$ of each stator blade 22 is about 59.7

It should be noted the blade angles of the rotor blades 12 and the stator blades 22 are set in opposite circumferential direction as depicted in the drawings.

Figure 7:
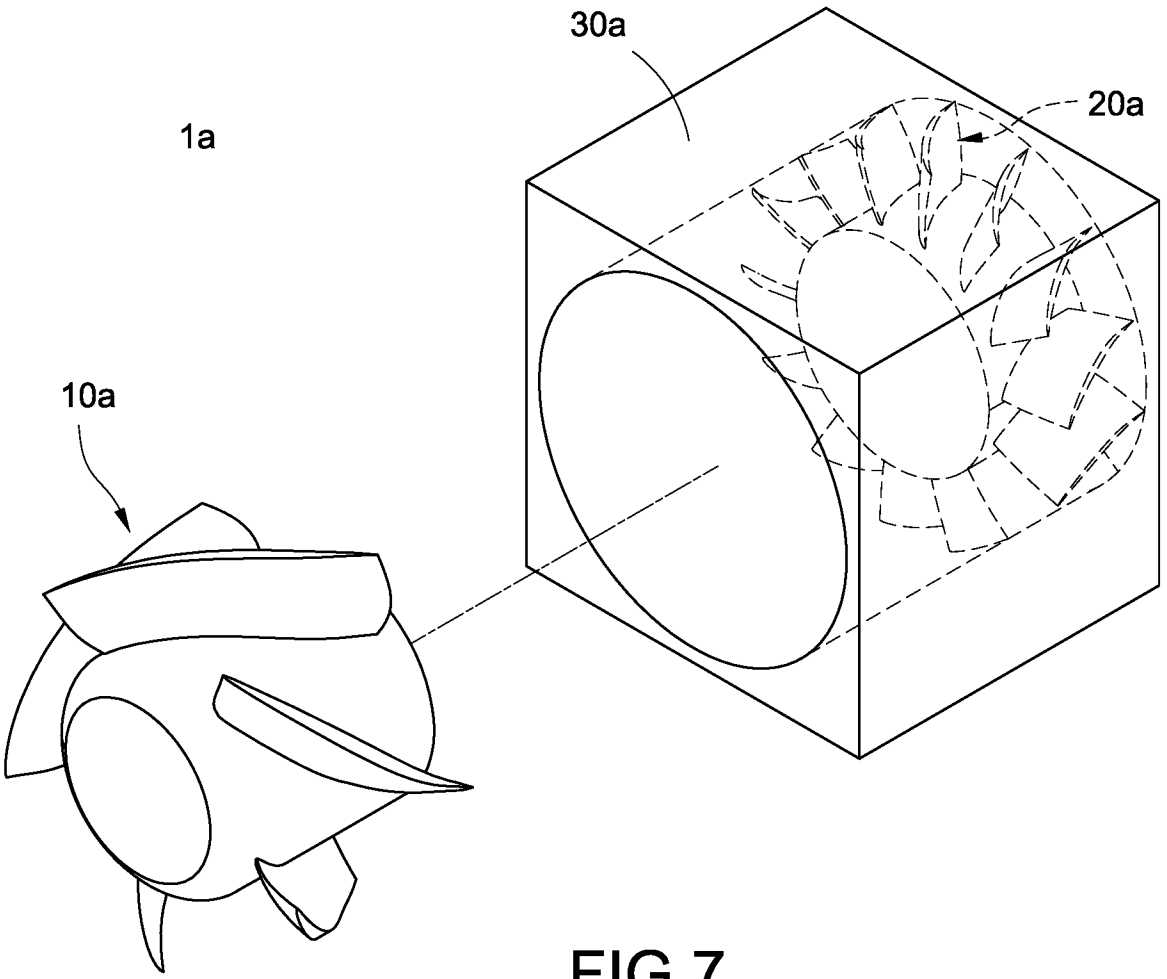
FIG. 7 is another embodiment of the air moving device with stator blade structure in this disclosure.

Please refer to FIG. 7, which depict another embodiment of the air moving device with stator blade structure in this disclosure. In this embodiment, the air moving device 1*a* includes a rotor 10*a*, a stator 20*a*, and a housing 30*a*. The rotor 10*a* is combined in the housing 30*a*. The stator 20*a* is fixed on the housing 30*a* and disposed on a downstream side of the rotor 10*a*.

Moreover, the design parameters of this embodiment are as follows. The ratio of the total thickness to the rotor diameter is about 0.923. The ratio of the hub diameter to the rotor diameter is about 0.628. The ratio of the stator axial thickness to the rotor axial thickness is about 0.469. The quantity of the rotor blades is 5, and the quantity of the stator blades is 14. The averaged blade angle of each rotor blade is about 47.5, and the averaged blade angle of each stator blade is about 60.2.

Figure 8:
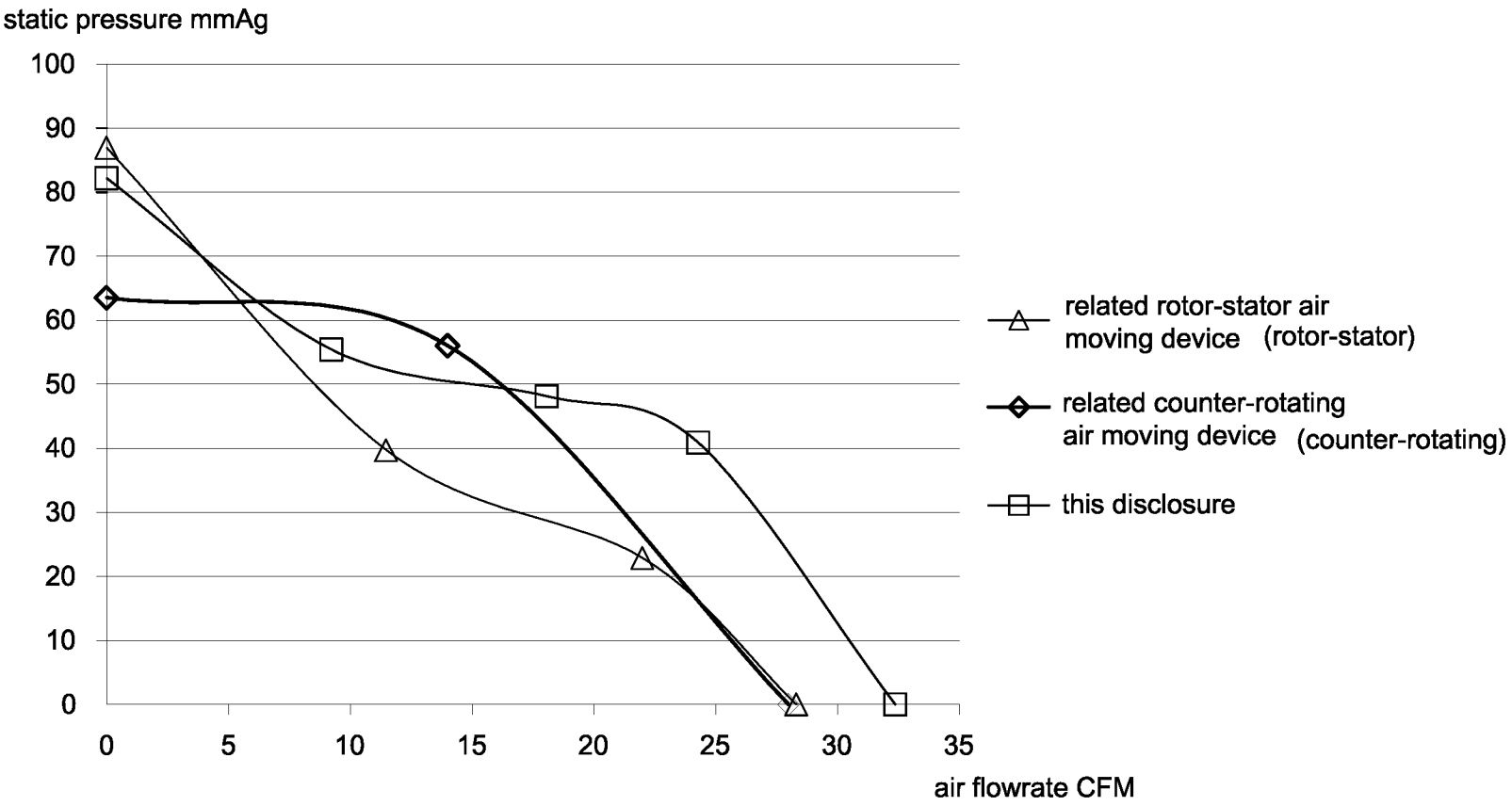
FIG. 8 is a comparison diagram of the curve of the static pressure versus air flowrate of the air moving device with stator blade structure of this disclosure and the air moving device of the related art under the conditions of same rotor diameters and rotation speeds

Please further refer to FIG. 8, which depicts a comparison diagram of the curve of the static pressure versus air flowrate of the air moving device with stator blade structure of this disclosure, the air moving device with stator blades of the related art, and the contra-rotating air moving device of the related art under the same rotor diameter and rotation speed. When comparing the characteristic curve of the air moving device with stator blade structure of this disclosure (the curve of this disclosure) with the characteristic curve of the air moving device with stator blades of the related art (related rotor-stator), the air moving device with stator blade structure of this disclosure has a higher air flowrate under the same flow pressure.

Furthermore, when comparing the characteristic curve of the air moving device with stator blade structure of this disclosure with the characteristic curve of the counter-rotating air moving device of the related art (related counter-rotating air moving device), the performance of this disclosure in the area of common operation (the right section of the curve) is similar to the counter-rotating air moving device of the related art, or even better.

It should be noted that the air moving device with stator blade structure of this disclosure only uses a single motor to drive the rotor blades. However, the counter-rotating moving device of the related art needs two motors to drive the front rotor and rear rotor. Therefore, the cost of the air moving device with stator blade structure of this disclosure is significantly reduced comparing to the counter-rotating moving device of the related art.

Figure 9A:
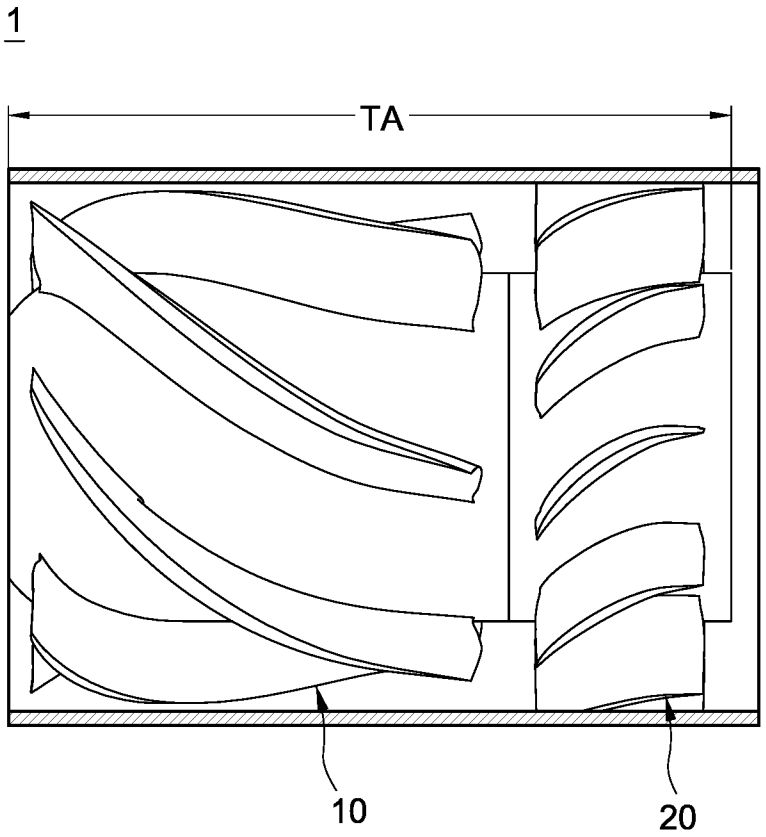
FIG. 9A is a side cross sectional view of the air moving device with stator blade structure in this disclosure.
Figure 9B:
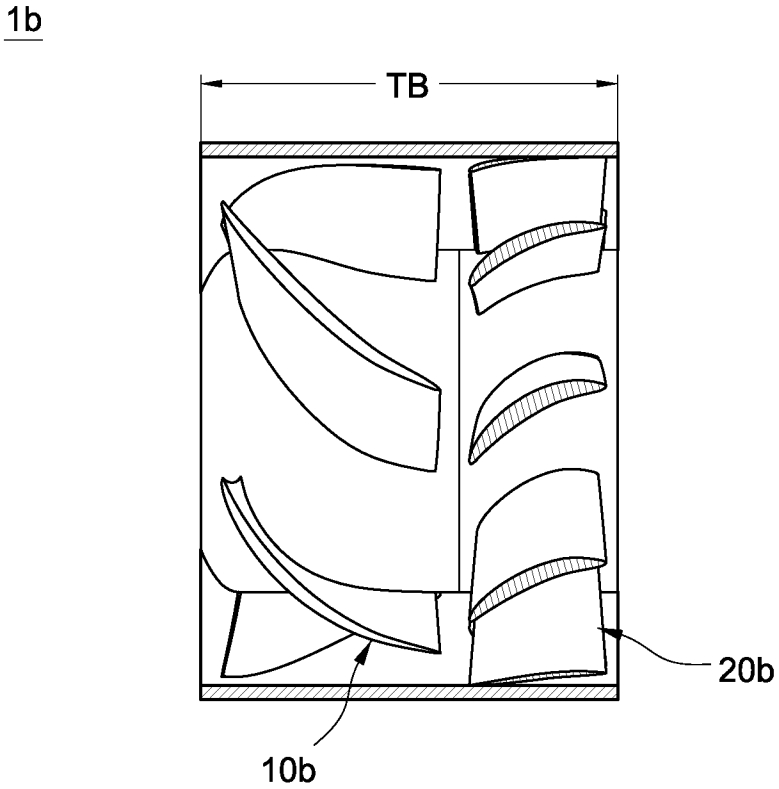
FIG.9B (Related Art)
FIG. 9B is a side cross sectional view of the rotor-stator air moving device in the related art.
Figure 9C:
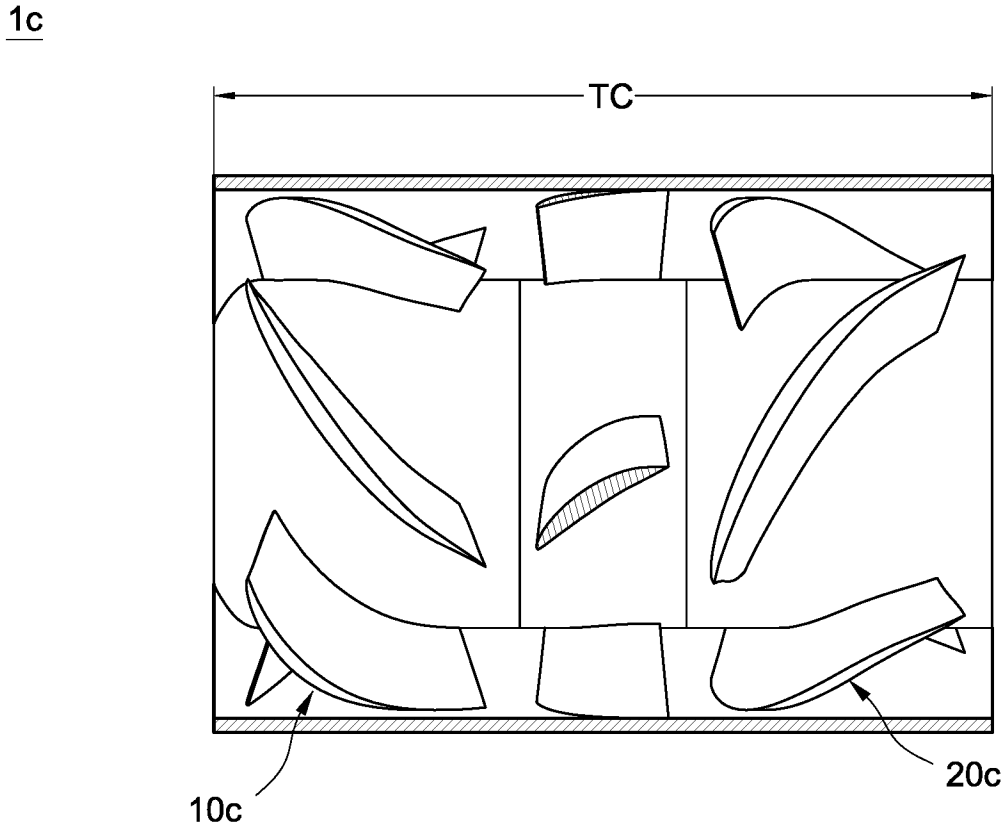
FIG.9C (Related Art)
FIG. 9C is a side cross sectional view of the counter-rotating air moving device in the related art.
Figure 10:
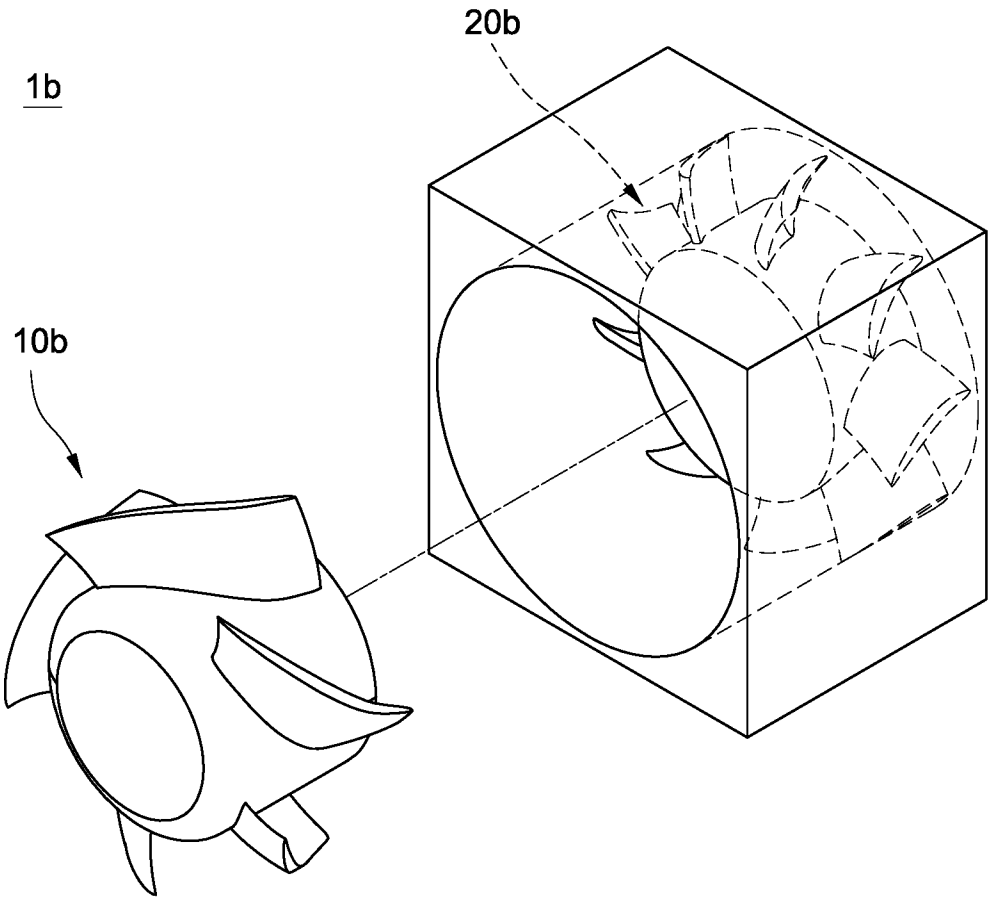
FIG.10 (Related Art)
FIG. 10 is a perspective exploded schematic view of the rotor-stator air moving device in the related art.
Figure 11:
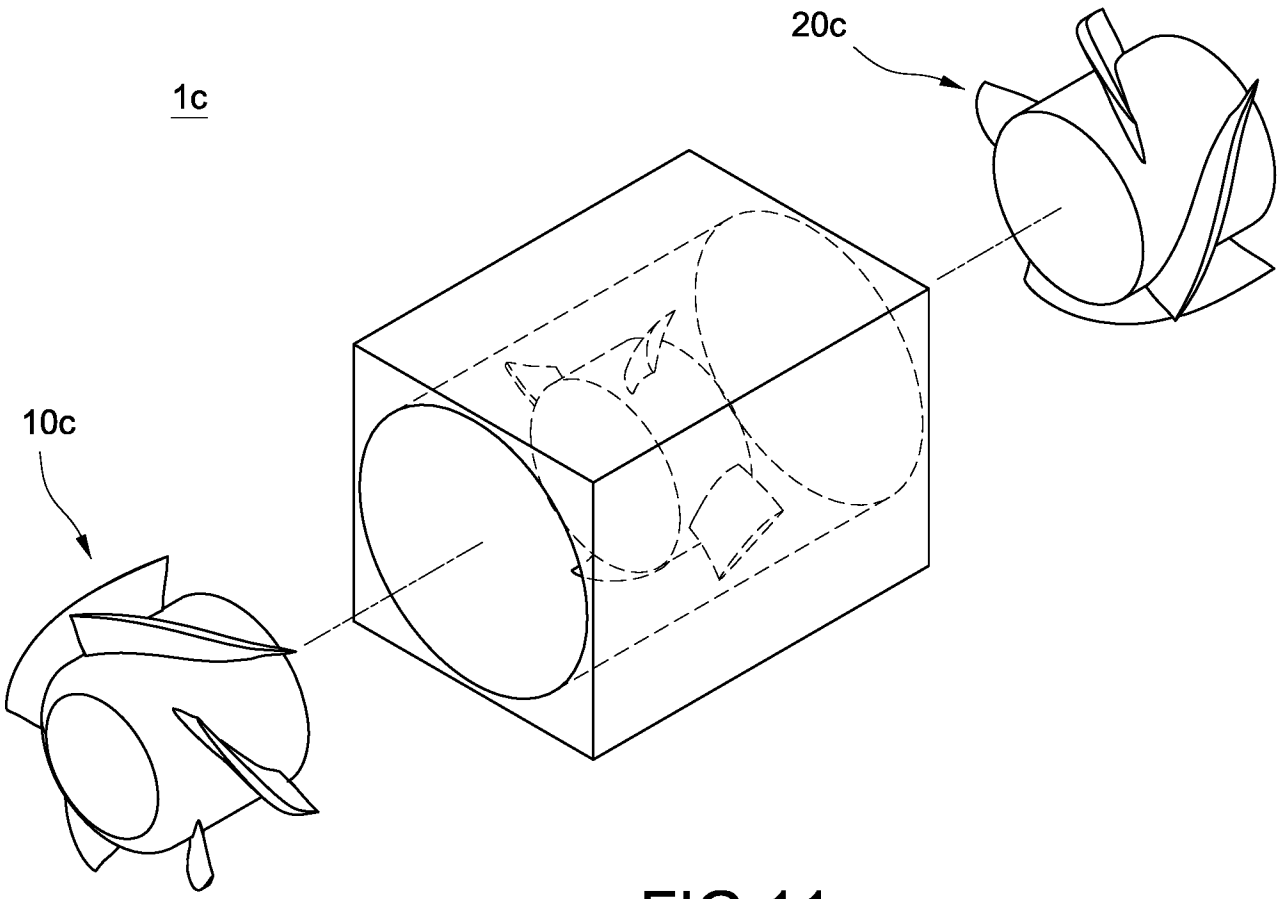
FIG.11 (Related Art)
FIG. 11 is a perspective exploded schematic view of the counter-rotating air moving device in the related art.

Please further refer to FIG. 9A to FIG. 9C, they respectively depict a side cross sectional view of the air moving device with stator blade structure in this disclosure, a side cross sectional view of the rotor-stator air moving device of the related art, and a side cross sectional view of the counter-rotating air moving device of the related art. In FIG. 9A, the air moving device 1 complies with the design parameters of this disclosure, and the air moving device 1 is with a total thickness TA (the thickness of the rotor 10 combined with the stator 20). In addition, in FIG. 9B, the rotor-stator air moving device 1*b* is with a total thickness TB (the thickness of the rotor 10*b* combined with the stator 20*b*). In FIG. 9C, the counter-rotating air moving device 1*c* includes a front rotor 10*c* and a rear rotor 20*c*, and the air moving device 1*c* is with a total thickness TC (the thickness of the front rotor 10*c* combined with the in-between stator and the rear rotor 20*c*).

Furthermore, please refer to FIG. 9A and FIG. 9B, under the condition of the rotor disposed with the stator with the same diameters, the total thickness TB of the rotor-stator air moving device 1*b* of the related art is significantly thinner than that of the total thickness TA of the air moving device 1 of this disclosure. Moreover, please refer to FIG. 9B and FIG. 9C, the total thickness TB of the rotor-stator air moving device 1*b* of the related art is significantly thinner than that of the total thickness TC of the counter-rotating air moving device 1*c* of the related art. However, please refer to FIG. 9A and FIG. 9C. The total thickness TA of the air moving device 1 of this disclosure is close to the total thickness TC of the counter-rotating air moving device 1*c* of the related art.

It should be noted that in order to enhance the operation performance of the air moving, the air moving device of the related art may adopt a rotor-stator moving device to improve the characteristic of static pressure versus air flow-rate of the air moving device. However, the total thickness of the rotor-stator moving device of the related art is usually thinner under the conventional design concept of the related art (refer to the above comparison of FIG. 9A and FIG. 9B). Therefore, when the total thickness of the related rotor-stator air moving device is up to a certain level, the related design may change to a counter-rotating air moving device to further enhance the performance of the air moving device, and the total thickness of the counter-rotating moving device is usually thicker (refer to the above comparison of FIG. 9B and FIG. 9C). It is worthy of noting that although the design of the air moving device of this disclosure is a rotor-stator air moving device, the total thickness of the rotor-stator air moving device is close to that of a counter-rotating air moving device of the related art.

Therefore, it should be noted that although the total thickness of the air moving device with the stator blade structure of this disclosure is thick, it can overcome the limitation of total thickness of the rotor-stator air moving device of the related art under the specific design parameters disclosed in this disclosure to achieve the characteristic curve close to that of the counter-rotating air moving device.

In summary, the air moving device with the stator blade structure of this disclosure achieves a better performance by specific design parameters and larger total thickness when comparing with the air moving device with stator blade structure of the related art. On the other hand, when comparing with the counter-rotating air moving device of the related art, the air moving device of this disclosure may achieve the performance close to that of the counter-rotating air moving device (dual motors driving double rotors) by a single motor. Thus, the air moving of this disclosure has advantages of reducing costs and simplifying manufacturing.

While this disclosure has been described by means of specific embodiments, numerous modifications and variations could be made thereto by those skilled in the art without departing from the scope and spirit of this disclosure set forth in the claims.

What is claimed is:

1. An air moving device with a stator blade structure, the air moving device comprising:

a rotor, comprising a rotor hub and a plurality of rotor blades arranged annularly on a periphery of the rotor hub spacedly;

wherein a quantity of the plurality of rotor blades is equal to or greater than 5 and equal to or less than 12, and an average blade angle of the plurality of rotor blades is equal to or greater than 45 degrees and equal to or less than 64 degrees, and a ratio of a hub diameter of the rotor hub to a rotor diameter of the plurality of rotor blades is equal to or greater than 0.4 and equal to or less than 0.79; and a stator, disposed on a downstream side of the rotor, the stator comprising a plurality of stator blades arranged annularly and spacedly;

wherein a quantity of the plurality of stator blades is equal to or greater than 6 and equal to or less than 23, and an average blade angle of the plurality of stator blades is equal to or greater than 45 degrees and equal to or less than 70 degrees; and wherein a ratio of a total thickness of the air moving device to the rotor diameter is equal to or greater than 0.76 and equal to or less than 1.7, and a ratio of a stator axial thickness of the plurality of stator blades to a rotor axial thickness of the plurality of rotor blades is equal to or greater than 0.28 and equal to or less than about 0.65.

2. The air moving device in claim 1, further comprising a housing, wherein the rotor is combined in the housing, and the stator is fixed on the housing.

3. The air moving device in claim 1, wherein the stator further comprises a stator hub, and the plurality of stator blades are arranged annularly on a periphery of the stator hub spacedly.

4. The air moving device in claim 1, wherein the respective blade angles of the plurality of rotor blades and the plurality of stator blades are set in opposite circumferential directions.

5. The air moving device in claim 1, wherein the ratio of the total thickness of the air moving device to the rotor diameter is 1.52;

the ratio of the hub diameter to the rotor diameter is 0.679;

the ratio of the stator axial thickness to the rotor axial thickness is 0.39;

the quantity of the plurality of rotor blades is 6, and the quantity of the plurality of stator blades is 11; and the average blade angle of the plurality of rotor blades is 53.2, and the average blade angle of the plurality of stator blades is 59.7.

6. The air moving device in claim 1, wherein the ratio of the total thickness of the air moving device to the rotor diameter is 0.923;

the ratio of the hub diameter to the rotor diameter is 0.628;

the ratio of the stator axial thickness to the rotor axial thickness is 0.469;

the quantity of the plurality of rotor blades is 5, and the quantity of the plurality of stator blades is 14; and the average blade angle of each of the plurality of rotor blades is 47.5, and the average blade angle of each of the plurality of stator blades is 60.2.

* * * * *